US007952456B2

(12) United States Patent
Rosemann et al.

(10) Patent No.: US 7,952,456 B2
(45) Date of Patent: May 31, 2011

(54) IGNITION COIL FOR AN INTERNAL COMBUSTION ENGINE

(75) Inventors: Friedhelm Rosemann, Lüdenscheid (DE); Stefan Wasserfuhr, Marienheide (DE)

(73) Assignee: Pulse Electronics GmbH (DE)

( * ) Notice: Subject to any disclaimer, the term of this patent is extended or adjusted under 35 U.S.C. 154(b) by 692 days.

(21) Appl. No.: 10/587,107

(22) PCT Filed: Jan. 21, 2005

(86) PCT No.: PCT/EP2005/000601

§ 371 (c)(1), (2), (4) Date: May 8, 2008

(87) PCT Pub. No.: WO2005/071701

PCT Pub. Date: Aug. 4, 2005

(65) Prior Publication Data

US 2008/0224810 A1 Sep. 18, 2008

(30) Foreign Application Priority Data

Jan. 22, 2004 (DE) ..... 10 2004 003 223

(51) Int. Cl.
*H01F 27/02* (2006.01)

(52) U.S. Cl. ..... 336/92; 336/90; 123/634; 123/635

(58) Field of Classification Search ..... 336/92, 336/90; 123/634, 635

See application file for complete search history.

(56) References Cited

U.S. PATENT DOCUMENTS 1,839,038 A * 12/1931 Kronmiller ..... 336/84 R
3,303,835 A * 2/1967 Richards ..... 123/633
3,436,704 A 4/1969 Keto et al.
4,224,068 A * 9/1980 Harvey ..... 419/22
4,586,015 A * 4/1986 Takahara et al. ..... 336/84 C
4,602,308 A * 7/1986 Montague ..... 361/91.5
5,406,926 A * 4/1995 Gu ..... 123/617

(Continued)

FOREIGN PATENT DOCUMENTS

DE 19909211 A1 9/1999

(Continued)

OTHER PUBLICATIONS

International Search Report (in English) for PCT/EP2005/000601, ISA/EP, Rijswijk, NL, May 17, 2005.

(Continued)

*Primary Examiner* — Anh T Mai
*Assistant Examiner* — Joselito Baisa
(74) *Attorney, Agent, or Firm* — Harness, Dickey & Pierce, P.L.C.

(57) ABSTRACT

The invention relates to an ignition coil for an internal combustion engine. Said ignition coil comprises a primary coil base (2) carrying a primary winding (1) and having an especially cylindrical shape, a low voltage connection area (10) for connecting the primary winding (1) to a low voltage, a secondary winding (3) inductively coupled to the primary winding (1) and disposed on an especially cylindrical secondary coil base (4), for providing a high voltage for the spark plug of the internal combustion engine. The primary coil base (2) and the secondary coil base (4) are mounted concentric to one another. The ignition coil also comprises a high-voltage connection area (5) in which the secondary winding (3) contacts the spark plug. The aim of the invention is to improve the ignition coil of the aforementioned type with respect to its electromagnetic compatibility. For this purpose, an electrically conducting layer (16) which has a substantially cylindrical shape and mechanical damping properties is provided inside an annular space defined by the outer winding of the two windings (1, 3). Said layer is configured as a sandwich structure and consists of at least two partial layers (16*a*, 16*b*) with an interposed intermediate layer (17).

20 Claims, 2 Drawing Sheets

U.S. PATENT DOCUMENTS

Figure 1:
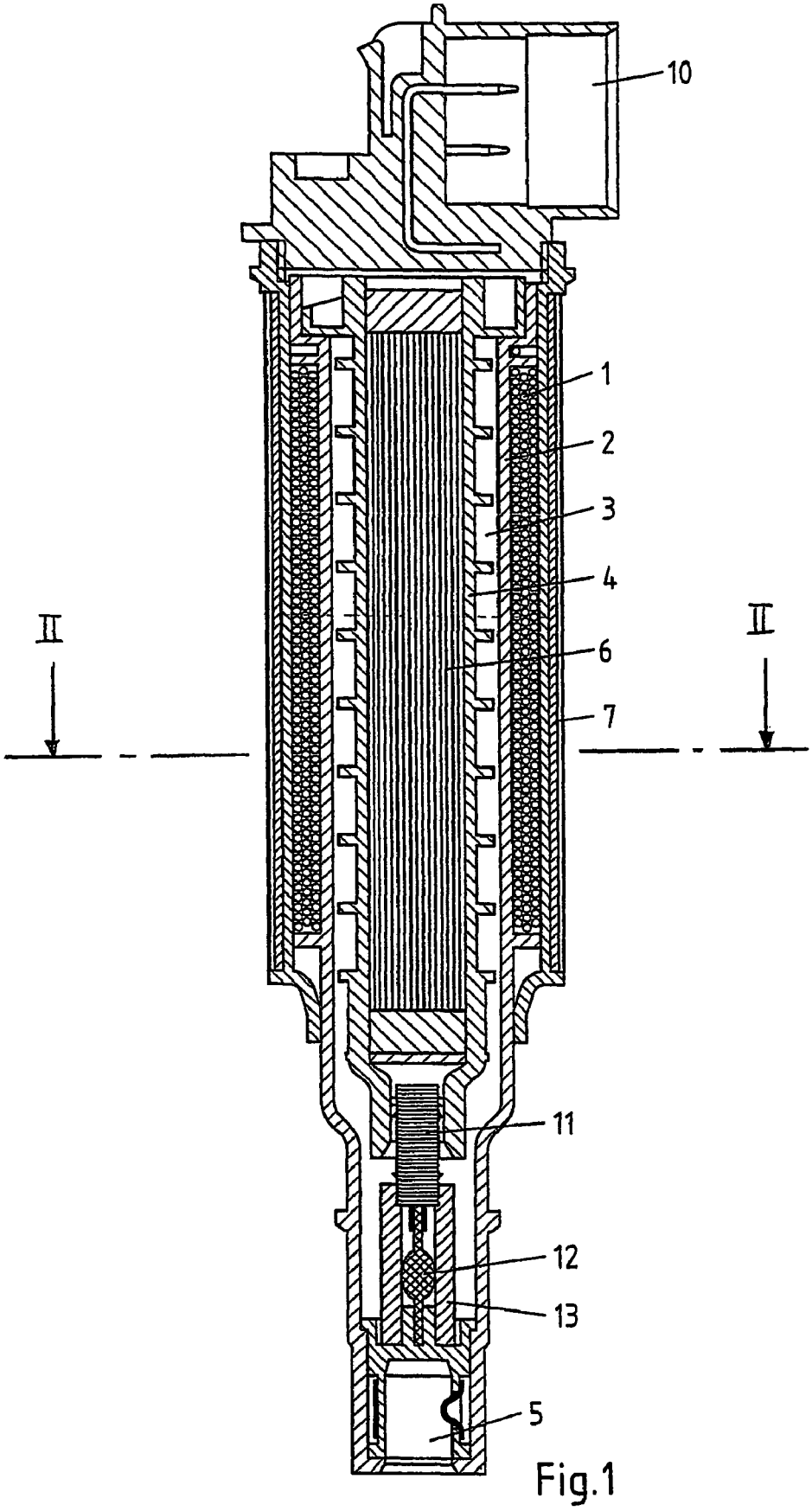

| | | | | |
|---|---|---|---|---|
| 6,087,918 | A * | 7/2000 | Henry et al. | 336/96 |
| 6,360,706 | B1 * | 3/2002 | Skinner et al. | 123/169 PH |
| 6,463,918 | B1 * | 10/2002 | Moga et al. | 123/633 |
| 6,965,228 | B2 * | 11/2005 | Muller et al. | 324/207.26 |
| 7,123,121 | B2 * | 10/2006 | Park | 336/84 C |

FOREIGN PATENT DOCUMENTS

| | | | |
|---|---|---|---|
| DE | 19927820 | C1 | 7/2000 |
| DE | 10057567 | A1 | 5/2002 |
| JP | 54-137116 | | 10/1979 |
| JP | 54-144924 | | 11/1979 |

OTHER PUBLICATIONS

Written Opinion (in German) of the International Search Authority for PCT/EP2005/000601, ISA/EP, Rijswijk, NL, May 17, 2005.

English translation of the International Preliminary Report for PCT/EP2005/000601.

* cited by examiner

IGNITION COIL FOR AN INTERNAL COMBUSTION ENGINE

The invention is directed to an ignition coil for an internal combustion engine with a substantially cylindrical primary coil base carrying a primary winding, a low voltage connection area for the connection of the primary winding to a low voltage, a secondary winding inductively coupled with the primary winding inductively and disposed on a substantially cylindrical secondary coil base for providing a high voltage for a spark plug of the internal combustion engine, wherein the primary coil base and secondary coil base are positioned concentric to one another, and a high voltage connection area, in which the secondary winding contacts the spark plug.

An ignition coil of this kind is known from DE 100 57 567.

With generic ignition coils, it concerns a so-called "rod coil for ignition equipment of an internal combustion engine", which includes a long configuration, so that it can be positioned in the narrow, limited space available in the engine block of the internal combustion engine. A primary voltage is applied to the primary winding over the low voltage area, which, as a result of the inductive coupling between the primary and secondary winding, is available as a high transformed voltage to the high voltage connection area of the secondary winding and charges the ignition coil there. With known ignition coils, a magnetic circuit is formed through the primary and secondary coil as well as the cylindrical magnetic coil and the magnetically conductive shell. For the avoidance of eddy current losses in the also metallic, conductive shell, the shell includes a continuous lengthwise slit so that induced electrical eddy currents are minimized.

An important functional feature of such an ignition coil is the so-called "electromagnetic compatibility" (EMC). In this connection, it is a matter of the opposing electromagnetic influence of transmitting and receiving devices. In conjunction with ignition coils, the requirements in relation to the EMC are particularly critical, for example, it must be ensured that the emitted electromagnetic interference of the ignition coil may only indirectly or directly have no or an acceptably low impact on the radio reception in the vehicle. As a result of the arrangement of the normally open magnetic circuits formed by the ignition coil and the used alternating current frequency, an adequate dampening of electromagnetic interference is not usually provided with traditional ignition coils.

An ignition coil in accordance with the preamble of claim 1 is known from DE 199 27 820 C1. Reference is further made to DE 199 09 211 A1 as prior art.

It is the object of the invention to improve an ignition coil of the above-described kind with respect to its electromagnetic compatibility (EMC) and at the same time with respect to its mechanical stability.

This object is achieved in accordance with the invention in that an electrically conductive, substantially cylindrical formed layer with mechanical dampening characteristics is located within an annular space that is defined by the outermost winding of the two windings. The invention is characterized in that a clear reduction of the electromagnetic emitted interference can be achieved through the conductive layer, which is located between the primary and secondary coils, without depleting the magnetic characteristics of the coil as such. Thereby, the conductive layer located between the primary and secondary coil has surprisingly no influence on the magnetic characteristics of the ignition coil, but instead helps the ignition coil to a substantially improved shielding effectiveness.

It is further provided that the layer is formed as a sandwich structure comprising at least two partial layers with a therebetween lying intermediate layer with mechanical dampening characteristics.

Through the arrangement as a sandwich structure is not only the electromagnetic compatibility (EMC) improved, but particularly also the stability of the ignition coil. The primary and secondary coils are coupled relative to one another, namely in an advantageous manner, through the mechanical cushioning.

Further preferred embodiments are provided from the dependent claims.

Figure 2A:
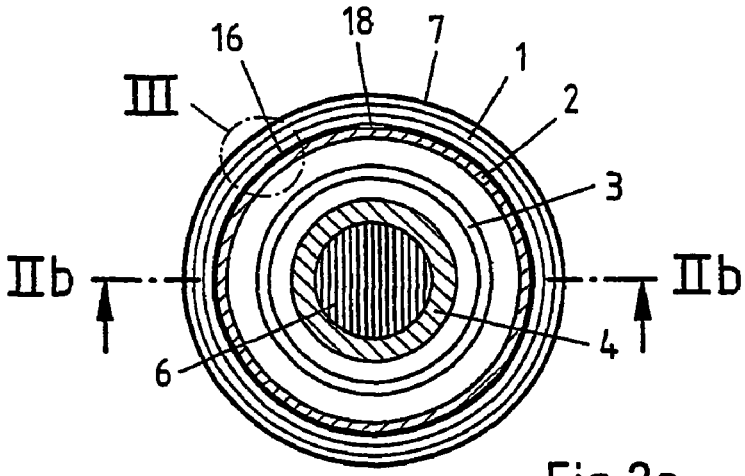
Figure 2B:
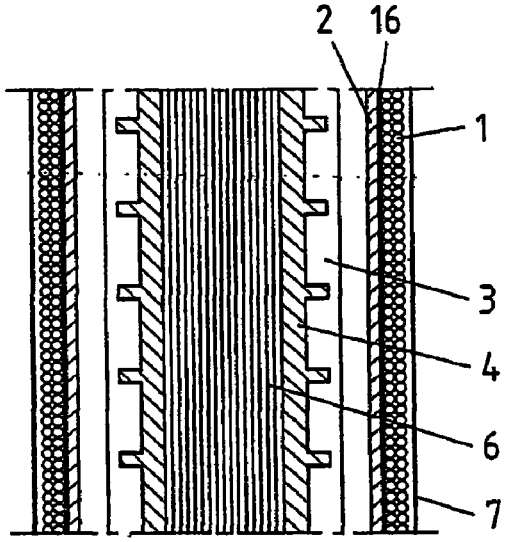

The invention will be more specifically described in the following by means of an exemplary embodiment. Thereby illustrates:

FIG. 1 a longitudinal section through an ignition coil in accordance with the exemplary embodiment of the invention;

FIG. 2*a* a section along the line II-II in FIG. 1;

FIG. 2*b* a section along the line IIb-IIb in FIG. 2*a;*

Figure 3:
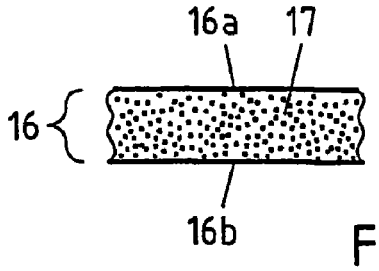

FIG. 3 an enlarged view along the line III in FIG. 2*a.*

FIG. 1 illustrates a longitudinal section through an exemplary embodiment of an ignition coil in accordance with the present invention, which includes a low voltage connection 10 in its upper area, at which the ignition coil is charged with the required low voltage. In its lower area, the ignition coil includes a high voltage connection area 5, in which a connection segment meets a spark plug (not shown).

The ignition coil includes a cylindrical configuration. A cylindrical magnetic core 6 is formed in the interior of the ignition coil and comprises layered magnetic sheets, in particular silicon iron sheets. Several magnetic sheets of different widths are so stacked and connected under insulation of the individual sheets relative to one another to form the core 6 with an approximately circular contour. The core 6 is surrounded by a secondary coil base 4, which supports a secondary winding 3 that is electrically connected with the high voltage connection area 5. The connection of the secondary winding 3 with the high voltage connection area 5 is achieved through a substantially anti-interference serving resistor 11 and a rectifying diode 12, which is housed in a housing 13.

The secondary coil base 4 is concentrically surrounded by a primary coil base 2, which supports a primary winding 1. The primary winding 1 is a three-layered winding in the illustrated exemplary embodiment. The coil unit is surrounded by a sleeve 7, which comprises an electrically conductive and at the same time magnetically conductive material, in particular a silicon iron sheet.

In the illustrated embodiment, the sleeve 7 is formed by two roll-formed magnetic sheets that are insulated from one another. The outer circumference of the sleeve 7 simultaneously forms the outer periphery of the described ignition coil. The sleeve 7, the primary winding 1, the secondary winding 3 and the core 6 form a magnetic circuit for generating the required ignition energy, with which the spark plug is charged. The sleeve 7 is provided with a continuous, lengthwise slit for the purpose of degrading eddy currents in the area of the magnetically conductive sleeve 7. One of the supply leads of the primary winding 1 extends along the lengthwise slit, namely that it is led out of the primary coil base 2 in the lower area of the primary winding 1 and must be coupled with the low voltage connection 10, similar to the supply lead that is led from the upper side of the primary coil base 2. The winding lead running along the lengthwise slit 8 is at the same time fixed within a slit area through an insulation layer, in which the winding lead is fixed in an appropriate embedding material. The embedding is preferably achieved by means of epoxy resin.

The cylindrical formed area between the output of the ends of the secondary winding 3 and the high voltage connection 5 serves on the one hand for the accommodation of the anti-interference serving resistor 11 and on the other hand for the accommodation of the diode 12, through which the rectification of the current flowing in the ignition coil is achieved, such that the negative impulse used for the ignition is allowed to pass, and the positive interfering impulse is, however, suppressed.

FIG. 2*a, b* illustrate the layer 16 located between the two windings 1, 3, which includes a lengthwise slit 18 for the abatement of eddy currents.

FIG. 3 illustrates the construction of the layer 16 provided in the annular space between the primary and secondary coils in the form of a sandwich structure. An intermediate layer 17 with absorption characteristics is formed between two conductive layers 16*a*, 16*b*, wherein the intermediate layer 17 itself also contains conductive particles, which likewise impart conductive characteristics to the intermediate layer 17.

Through the layer 16, the ignition coil on the one hand achieves an improved EMC—compatibility as a result of the improved shielding effectiveness, and the primary and secondary coil bodies are, on the other hand, substantially better cushioned relative to one another. The layer 16 is therewith coupled with ground. Thus, interference voltages, which could capacitively overcouple from the secondary winding to the primary winding, are electrically shorted. The connection of the layer 16 with ground is achieved, such that one of the two sub-layers 16*a*, 16*b* is electrically connected with the winding area of the primary winding 1 lying on ground. For this, the primary winding 1 is not insulated at the corresponding winding portion and through soldering or similar connection techniques contacts the corresponding partial layer. Alternative thereto, a connection technique is also possible, by which an additional conductor is provided, which couples the corresponding partial layer 16*a*, 16*b* with the winding end of the primary coil 1.

The invention claimed is:

1. An ignition coil for an internal combustion engine comprising:

a primary winding supported by a substantially cylindrical primary coil base;

a low voltage connection area for the connection of the primary winding to a low voltage;

a secondary winding that is inductively coupled with the primary winding and that is positioned on a substantially cylindrical secondary coil base to provide a high voltage for a spark plug of the internal combustion engine;

wherein the primary coil base and the secondary coil base are concentrically positioned relative to one another, and a high voltage connection area, in which the secondary winding contacts the spark plug;

wherein an electrically conductive, substantially cylinder formed layer with mechanical dampening properties is located within an annular space defined by the outermost winding of the two windings; and wherein the electrically conductive layer is formed as a sandwich structure comprising at least two partial layers with a intermediate layer with mechanical dampening characteristics lying therebetween.

2. An ignition coil for an internal combustion engine in accordance with claim 1, wherein the electrically conductive layer is located in the annular space located between the primary winding and the secondary winding, which surrounds the innermost winding of the two windings.

3. An ignition coil for an internal combustion engine in accordance with claim 1, wherein the electrically conductive layer surrounds a magnetic core disposed within the innermost winding of the two windings.

4. An ignition coil for an internal combustion engine in accordance with claim 1, wherein at least one of the partial layers is formed as a foil.

5. An ignition coil for an internal combustion engine in accordance with claim 4, wherein the foil includes an arrangement of openings at regular intervals, in particular in the form of a lattice net.

6. An ignition coil for an internal combustion engine in accordance with claim 1, wherein the intermediate layer is electrically conductive.

7. An ignition coil for an internal combustion engine in accordance with claim 6, wherein the electrically conductive intermediate layer is electrically coupled with the ground of the ignition coil.

8. An ignition coil for an internal combustion engine in accordance with claim 1, wherein the electrically conductive layer includes a slot running in the lengthwise direction of the ignition coil.

9. An ignition coil for an internal combustion engine in accordance with claim 1, wherein the electrically conductive layer is roll formed from a flat material, such that an overlapping of the material occurs at the adjoinment area.

10. An ignition coil for an internal combustion engine in accordance with claim 1, wherein contact of the electrically conductive layer with one of the two windings is achieved through a separate contact means, in particular a supply lead, which the electrically conductive layer and the corresponding winding enclose.

11. An ignition coil for an internal combustion engine in accordance with claim 1, wherein the contact of the electrically conductive layer with one of the two windings is achieved through direct contact of a conductive portion of the layer with an un-insulated portion of the corresponding winding.

12. The ignition coil of claim 1, wherein the intermediate layer of the electrically conductive layer is different than the two partial layers.

13. The ignition coil of claim 12, wherein the electrically conductive layer is between the primary winding and the secondary winding.

14. An ignition coil for an internal combustion engine comprising:

a primary winding supported by a substantially cylindrical primary coil base;

a low voltage connection area configured for connection of the primary winding to a low voltage source;

a secondary winding inductively coupled with the primary winding and positioned on a substantially cylindrical secondary coil base to provide high voltage for a spark plug of the internal combustion engine, the primary coil base and the secondary coil base are concentrically positioned relative to one another;

a high voltage connection area where the secondary winding contacts the spark plug; and an electrically conductive layer between the primary winding and the secondary winding, the electrically conductive layer is substantially cylindrical, located within an annular space defined by the primary winding, and includes:

an inner layer;

an outer layer; and an intermediate layer between the inner layer and the outer layer, the intermediate layer is different than the inner layer and the outer layer, and the intermediate layer includes mechanical dampening characteristics.

15. The ignition coil of claim 14, further comprising a cylindrical magnetic core that is surrounded by the secondary winding and the electrically conductive layer.

16. The ignition coil of claim 14, wherein the electrically conductive layer includes a slot running in a lengthwise direction of the ignition coil.

17. The ignition coil of claim 14, wherein the electrically conductive layer is roll formed from a flat material.

18. An ignition coil for an internal combustion engine comprising:

a cylindrical magnetic core;

a secondary winding surrounding the cylindrical magnetic core, the secondary winding supported by a secondary base;

a primary winding surrounding the secondary winding and supported by a primary base;

a cylindrical, electrically conductive layer between the primary winding and the secondary winding in an annular space defined by the primary winding, the electrically conductive layer including:

an inner layer;

an outer layer; and an intermediate layer between the inner layer and the outer layer, the intermediate layer is different than the inner layer and the outer layer, and the intermediate layer includes mechanical dampening characteristics; and an outer sleeve surrounding each of the cylindrical magnetic core, the secondary winding, the primary winding, and the cylindrical, electrically conductive layer.

19. The ignition coil of claim 18, wherein the intermediate layer includes conductive particles.

20. The ignition coil of claim 18, wherein the electrically conductive layer includes a slot running in a lengthwise direction of the ignition coil.

* * * * *